US010665408B2

(12) United States Patent
Kuzniarski et al.

(10) Patent No.: US 10,665,408 B2
(45) Date of Patent: May 26, 2020

(54) ELECTRICAL SWITCHING APPARATUS, MAINTAINING SYSTEM THEREFOR, AND ASSOCIATED MAINTAINING METHOD

(71) Applicant: EATON INTELLIGENT POWER LIMITED, Dublin (IE)

(72) Inventors: Thomas Ted Kuzniarski, Coraopolis, PA (US); Brian Scott Jansto, Beaver Falls, PA (US); Peggy Jo Marlin, Beaver, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 130 days.

(21) Appl. No.: 15/996,024

(22) Filed: Jun. 1, 2018

(65) Prior Publication Data

US 2019/0371556 A1 Dec. 5, 2019

(51) Int. Cl.
*H01H 71/02* (2006.01)
*H01H 71/10* (2006.01)

(52) U.S. Cl.
CPC ..... *H01H 71/0264* (2013.01); *H01H 71/10* (2013.01)

(58) Field of Classification Search
CPC ..... H01H 71/10; H01H 71/0264
USPC ..... 200/50.26, 293, 296, 333
See application file for complete search history.

(56) References Cited

U.S. PATENT DOCUMENTS 8,995,135 B2 * 3/2015 Ogatsu ..... H05K 5/0217 292/341.17
2015/0041290 A1 * 2/2015 Sisley ..... H01H 9/287 200/43.22
2016/0260560 A1 * 9/2016 Mishra ..... H01H 21/04

* cited by examiner

*Primary Examiner* — Edwin A. Leon
*Assistant Examiner* — Iman Malakooti
(74) *Attorney, Agent, or Firm* — Eckert Seamans Cherin & Mellott, LLC

(57) ABSTRACT

A maintaining system is for an electrical switching apparatus. The electrical switching apparatus includes an electrical switching apparatus cover having an edge portion defining a thru hole. The maintaining system includes a test port cover member and an insert. The test port cover member is structured to be coupled to the edge portion. The test port cover member has a plate portion and a pair of opposing leg portions extending from the plate portion. The leg portions are structured to extend into an interior of the electrical switching apparatus and engage the electrical switching apparatus cover. The insert extends through the plate portion. The insert is structured to engage each of the leg portions in order to prevent the leg portions from deflecting toward each other, thereby maintaining the test port cover member on the electrical switching apparatus cover.

14 Claims, 8 Drawing Sheets

ELECTRICAL SWITCHING APPARATUS, MAINTAINING SYSTEM THEREFOR, AND ASSOCIATED MAINTAINING METHOD

BACKGROUND

Field

The disclosed concept relates to electrical switching apparatus such as, for example, circuit breakers. The disclosed concept also relates to maintaining systems for circuit breakers. The disclosed concept further relates to methods of maintaining test port cover members on electrical switching apparatus covers of electrical switching apparatus.

Background Information

Electrical switching apparatus are used to protect electrical circuitry from damage due to a trip condition, such as, for example, an overcurrent condition, an overload condition, an undervoltage condition, a relatively high level short circuit or fault condition, a ground fault or arc fault condition. Electronic circuit breakers, for example, commonly include printed circuit board assemblies that are communicable with trip units in the circuit breaker to trip open separable contacts in the event of a trip condition. Electronic circuit breakers also often have thru holes in their electrical switching apparatus covers (i.e., housings), in order to allow external accessories access to the printed circuit board assemblies. However, when no external accessories are connected to the printed circuit board assemblies, it is desirable that the thru holes in the electrical switching apparatus covers be covered, so as to protect users who might be passing by the circuit breaker from potential arcing energies generated during tripping of the separable contacts. To perform this function, known circuit breakers often use test port cover members that block the thru holes in the electrical switching apparatus covers. However, it is desirable for test port cover members to be more reliably maintained on the electrical switching apparatus cover of the circuit breaker.

There is, therefore, room for improvement in electrical switching apparatus and in maintaining systems therefor.

There is also room for improvement in methods of maintaining a test port cover member on an electrical switching apparatus cover of an electrical switching apparatus.

SUMMARY

These needs and others are met by embodiments of the disclosed concept, which are directed to an improved electrical switching apparatus, maintaining system therefor, and associated maintaining method.

In accordance with one aspect of the disclosed concept, a maintaining system is provided for an electrical switching apparatus. The electrical switching apparatus includes an electrical switching apparatus cover having an edge portion defining a thru hole. The maintaining system includes a test port cover member and an insert. The test port cover member is structured to be coupled to the edge portion. The test port cover member has a plate portion and a pair of opposing leg portions extending from the plate portion. The leg portions are structured to extend into an interior of the electrical switching apparatus and engage the electrical switching apparatus cover. The insert extends through the plate portion. The insert is structured to engage each of the leg portions in order to prevent the leg portions from deflecting toward each other, thereby maintaining the test port cover member on the electrical switching apparatus cover.

In accordance with another aspect of the disclosed concept, an electrical switching apparatus is provided. The electrical switching apparatus includes an electrical switching apparatus cover having an edge portion defining a thru hole, a printed circuit board assembly comprising a circuit board coupled to the electrical switching apparatus cover, and the aforementioned maintaining system.

In accordance with another aspect of the disclosed concept, a method of maintaining a test port cover member of an electrical switching apparatus on an electrical switching apparatus cover of the electrical switching apparatus is provided. The method includes the steps of providing the electrical switching apparatus with the electrical switching apparatus cover having an edge portion defining a thru hole, a printed circuit board assembly comprising a circuit board coupled to the electrical switching apparatus cover, and a maintaining system comprising the test port cover member and an insert; providing the test port cover member with a plate portion and a pair of opposing leg portions extending from the plate portion; coupling the test port cover member to the edge portion by substantially extending the leg portions through the thru hole, the leg portions engaging the electrical switching apparatus cover; and extending the insert through the plate portion, the insert being structured to engage each of the leg portions in order to prevent the leg portions from deflecting toward each other, thereby maintaining the test port cover member on the electrical switching apparatus cover.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

Figure 1:
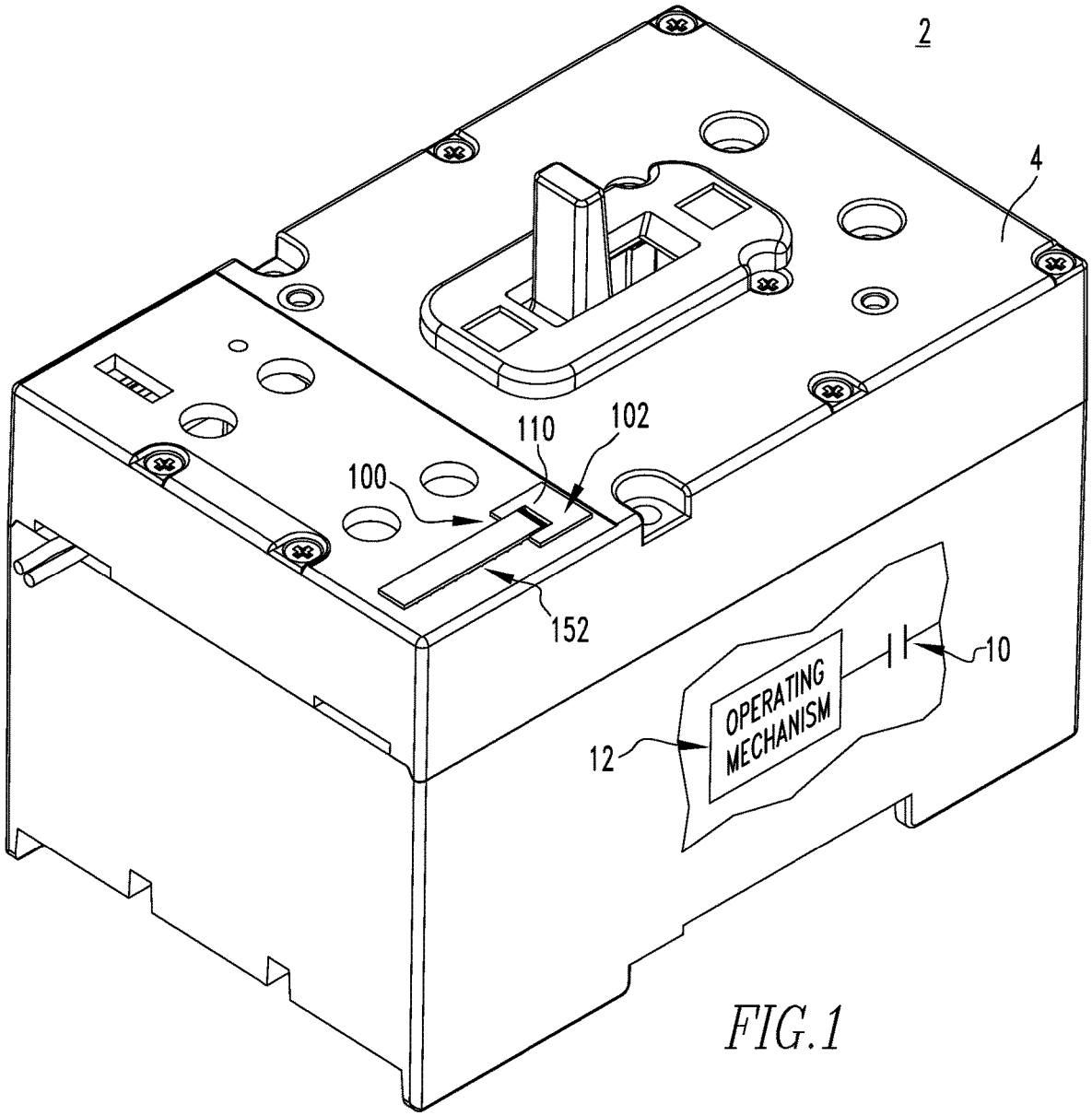
FIG. 1 is a partially simplified isometric view of an electrical switching apparatus and maintaining system therefor, in accordance with one non-limiting embodiment of the disclosed concept.
Figure 2:
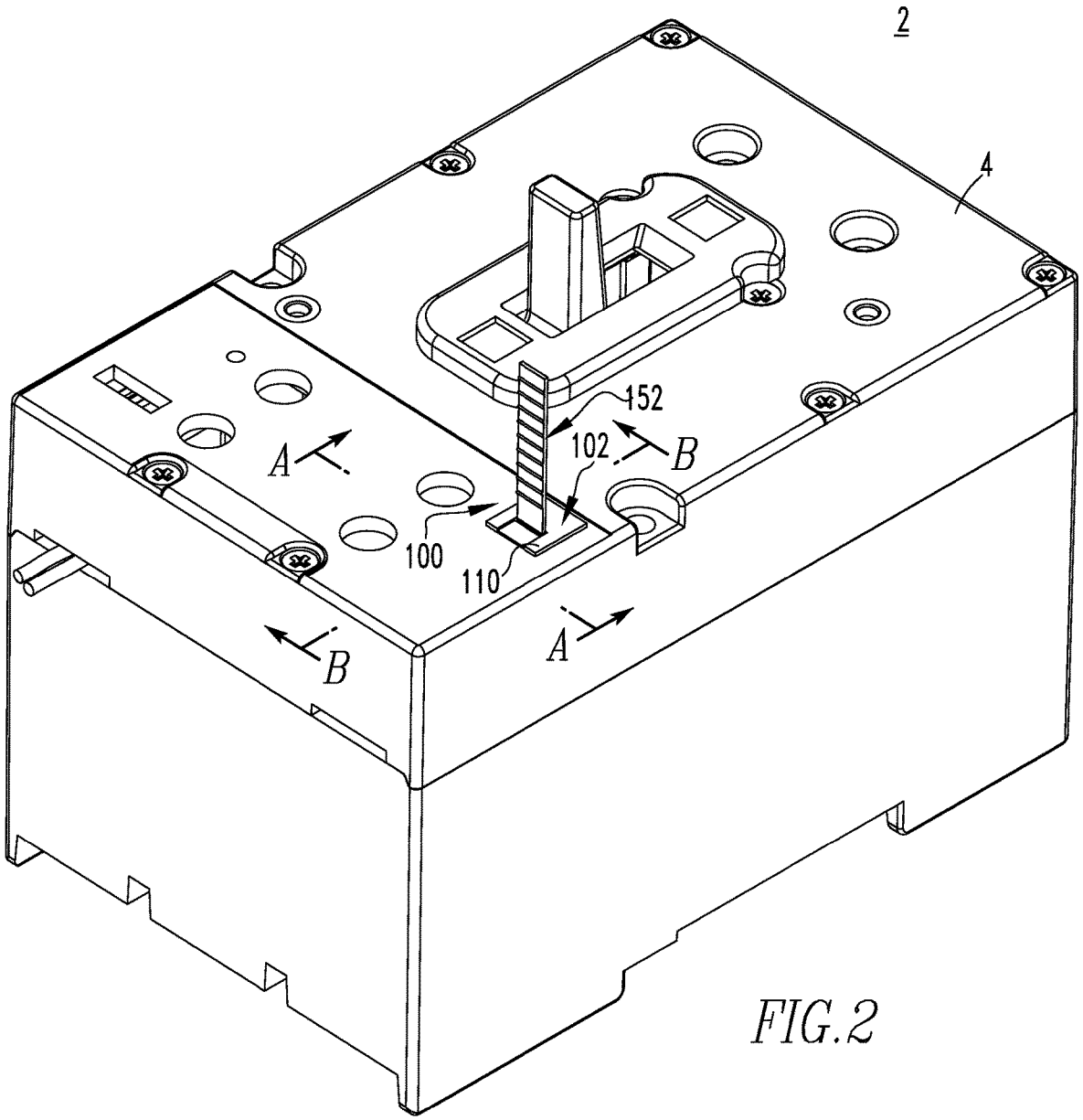
FIG. 2 is another isometric view of the electrical switching apparatus and maintaining system therefor of FIG. 1, shown prior to the gripping portion of the insert being pivoted about the hinge portion of the insert.

FIGS. 1 and 2 show isometric views of an electrical switching apparatus (e.g., without limitation, electronic circuit breaker 2) and a maintaining system 100 therefor, in accordance with one non-limiting embodiment of the disclosed concept. As shown in FIG. 1, the circuit breaker 2 includes an electrical switching apparatus cover 4 (e.g., a housing made of plastic or another suitable material), a pair of separable contacts 10 (shown in simplified form) located in an interior of the electrical switching apparatus cover 4, and an operating mechanism 12 (shown in simplified form) for opening and closing the separable contacts 10. As the circuit breaker 2 is an electronic circuit breaker, the circuit breaker 2 further includes a printed circuit board assembly 20 (partially shown in FIGS. 8 and 9). The printed circuit board assembly 20 has a circuit board 22 coupled to the electrical switching apparatus cover 4 and structured to cooperate with the operating mechanism 12. As will be discussed in greater detail below, the maintaining system 100 is advantageously structured to be reliably maintained on the electrical switching apparatus cover 4 during operation of the circuit breaker 2, and is still able to readily be removed should an operator need to access the printed circuit board assembly 20 in the interior of the circuit breaker 2.

Figure 3:
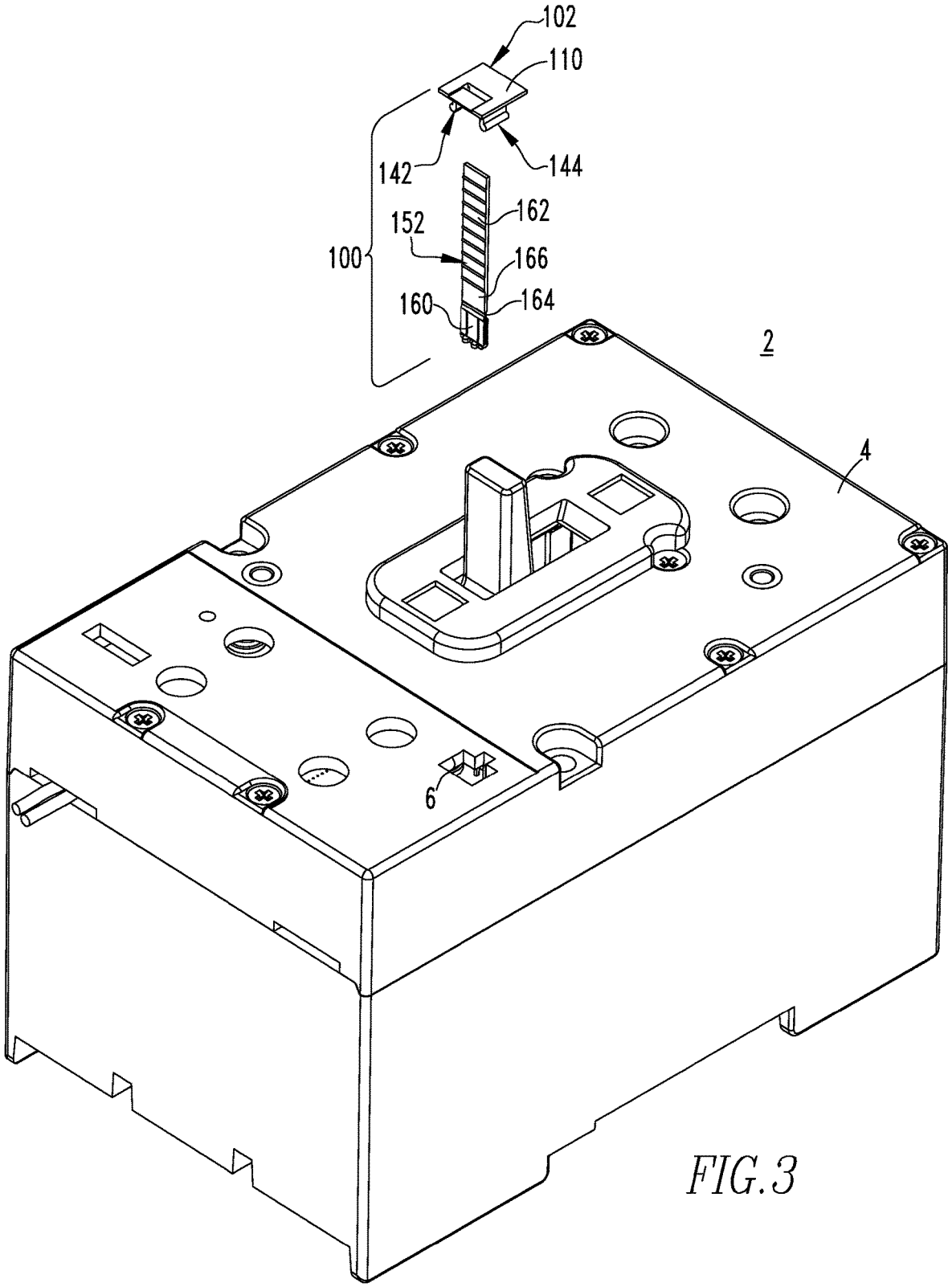
FIG. 3 is a partially exploded isometric view of the electrical switching apparatus and maintaining system therefor of FIG. 2.
Figure 3A:
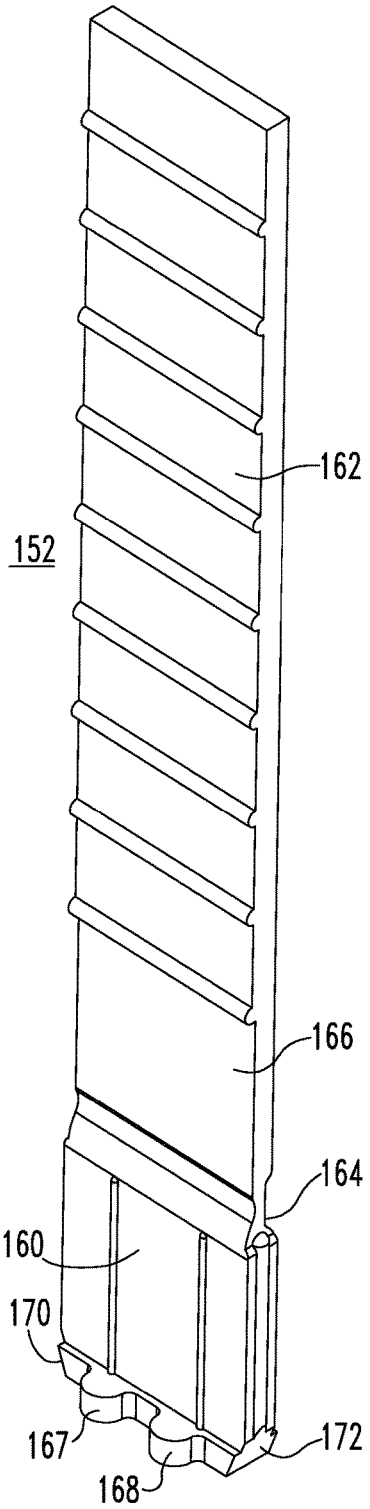
FIG. 3A is an isometric view of the insert for the maintaining system of FIG. 3.

FIG. 3 shows a partially exploded view of the circuit breaker 2. As shown, the electrical switching apparatus cover 4 has an edge portion 6 defining a thru hole into an interior of the circuit breaker 2. It will be appreciated that this thru hole provides access to the circuit board 22 (FIGS. 8 and 9) to allow operators to connect circuit breaker test kits (not shown) to the circuit board 22. Continuing to refer to FIG. 3, the maintaining system 100 preferably includes a test port cover member 102 and an insert 152, each preferably being unitary components made from single pieces of material. Referring to FIG. 3A, the insert 152 includes a blocking portion 160, a gripping portion 162, a hinge portion 164 extending between the blocking portion 160 and the gripping portion 162. In one example embodiment, the blocking portion 160 has a number of protrusions 167,168 extending from and being located substantially perpendicular to a body portion of the blocking portion 160. In one example embodiment the protrusions 167,168 are spaced from one another. Additionally, although not shown, an opposing side of the insert 152 has another corresponding number of protrusions performing the same function as the protrusions 167,168, as will be discussed below. Furthermore, the insert 152 has a pair of opposing tapered surfaces 170,172, each extending from the blocking portion 160 away from the gripping portion 162 and toward each other. It will also be appreciated herein that the gripping portion 162 is configured to pivot about the hinge portion 164.

Figure 4:
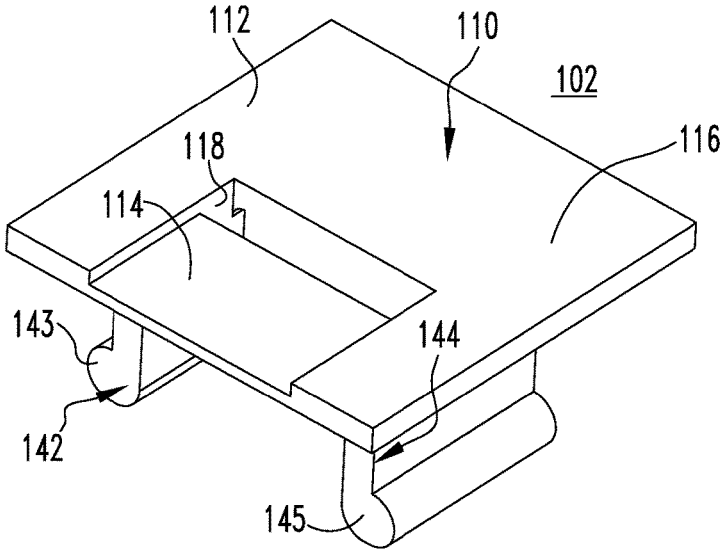
FIGS. 4 and 5 are front and rear isometric views, respectively, of a test port cover member for the maintaining system of FIG. 3.
Figure 5:
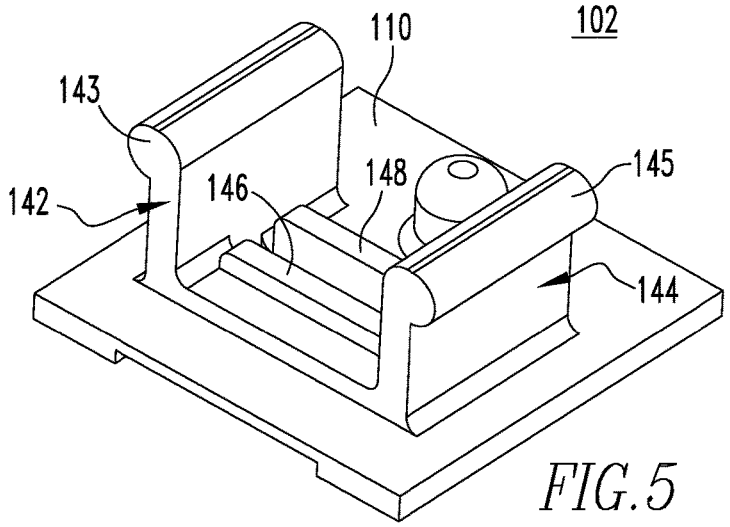

FIGS. 4 and 5 show different views of the test port cover member 102. As shown, the test port cover member 102 has a plate portion 110 and a pair of opposing leg portions 142,144 extending from the plate portion 110. The plate portion 110 includes a body portion 112 and a shelf portion 114. The body portion 112 has a top surface 116 and a cut-out region 118. The shelf portion 114 extends across the cut-out region 118. Furthermore, for purposes that will be discussed below, the shelf-portion 114 is spaced from and is located parallel to the top surface 116.

Referring to FIG. 5, the test port cover member 102 further includes first and second guide portions 146,148 each structured to extend, when installed, from the plate portion 110 toward an interior of the circuit breaker 2. The guide portions 146,148 are each preferably located substantially perpendicular to each of the leg portions 142,144. The function of the guide portions 146,148 will be discussed below.

Figure 6:
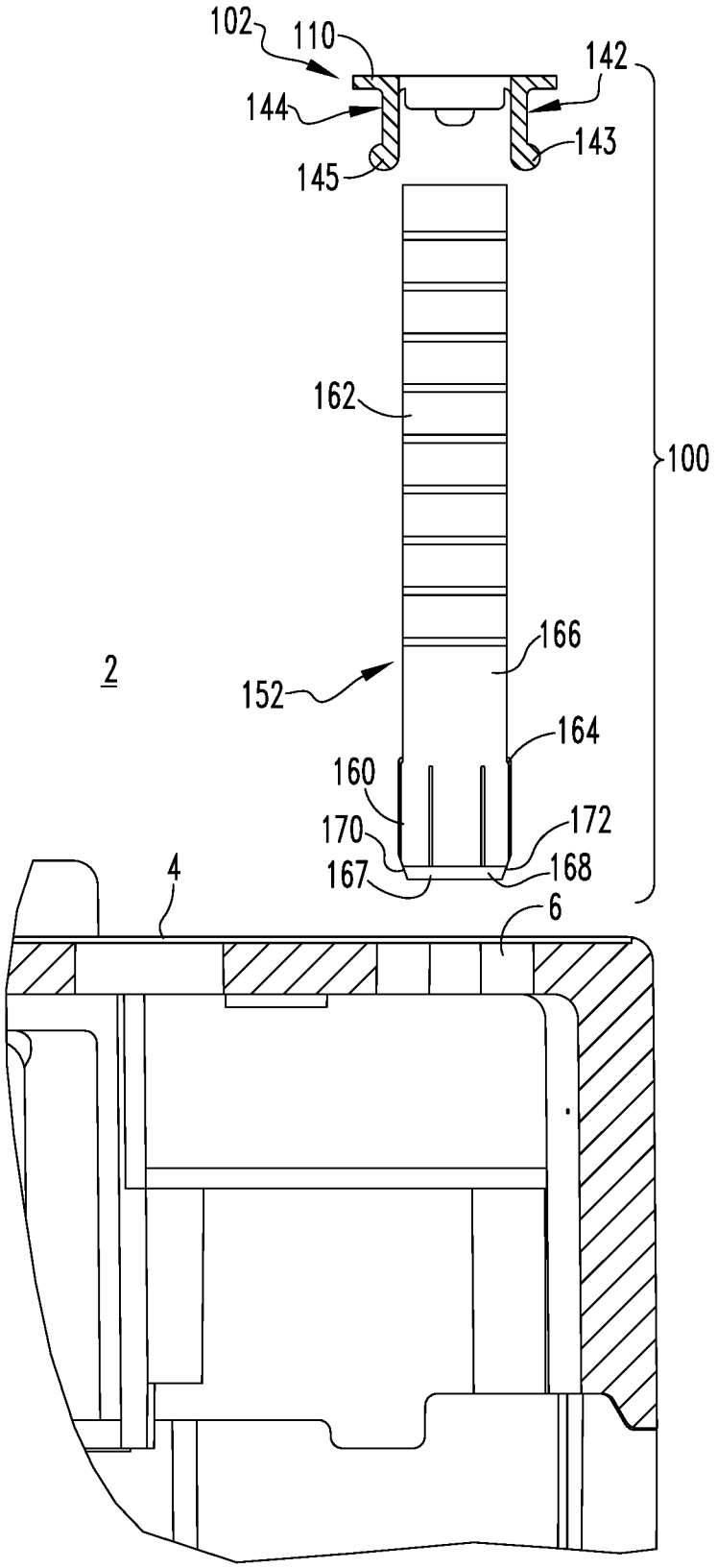
FIG. 6 is an exploded view of a portion of the electrical switching apparatus and maintaining system therefor of FIG. 3, shown with portions removed.
Figure 7:
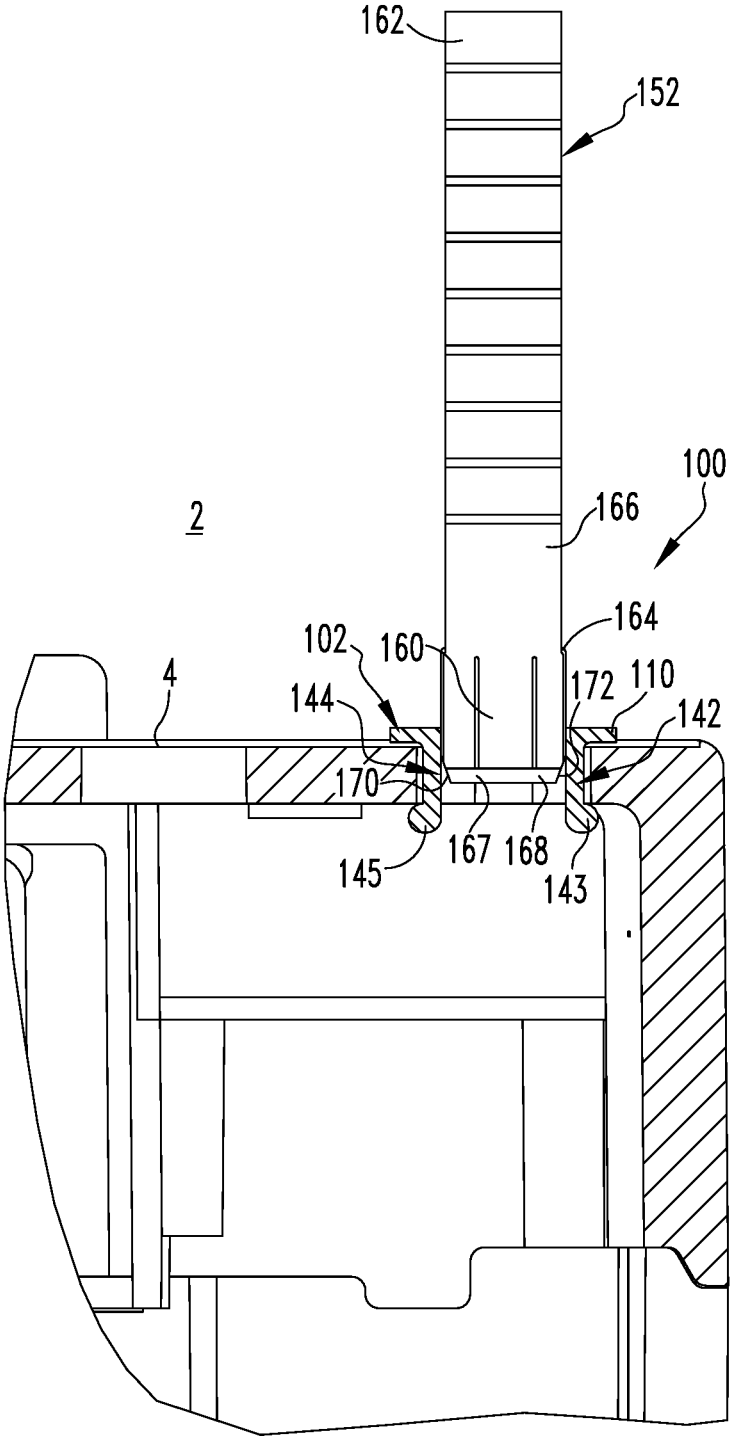
FIG. 7 is a view of the electrical switching apparatus and maintaining system therefor of FIG. 6, shown with the blocking portion of the insert having been partially pulled through the test port cover member.

As shown in FIGS. 6 and 7, it will be appreciated that during assembly of circuit breaker 2 and maintaining system 100 therefor, the gripping portion 162 of the insert 152 is first inserted through the test port cover member 102 until the protrusions 167,168 (e.g., and the protrusions of the corresponding opposing side of the insert 152, not shown) are disposed proximate and/or engage the guide portions 146,148. At this time, the test port cover member 102 (e.g., with the insert 152 inserted therethrough) is coupled to the edge portion 6 of the electrical switching apparatus cover 4. Specifically, the leg portions 142,144 are inserted through the thru hole defined by the edge portion 6. As this is happening, initially the leg portions 142,144 deflect toward each other, generally pivoting about the plate portion 110. One advantageous feature of the maintaining system 100 is that during this assembly, the tapered surfaces 170,172 allow the leg portions 142,144 to deflect toward each other. Specifically, rather than move directly into engagement with the insert 152, the tapered surfaces 170,172 provide some clearance to facilitate coupling of the test port cover member 102 onto the electrical switching apparatus cover 4.

Once the test port cover member 102 is pressed far enough through the thru hole, respective rounded distal portions 143,145 of the leg portions 142,144 move away from each other and press against (e.g., engage) the electrical switching apparatus cover 4. While this engagement provides a considerable amount of resistance against a potential ejection of the test port cover member 102, the maintaining system 100 provides a significant improvement over existing systems with the incorporation of the insert 152 and its use in combination with the test port cover member 102. Referring to FIG. 7, once the test port cover member 102 is coupled to the electrical switching apparatus cover 4, the insert 152 is pushed such that the blocking portion 160 moves into an interior of the circuit breaker 2.

Figure 8:
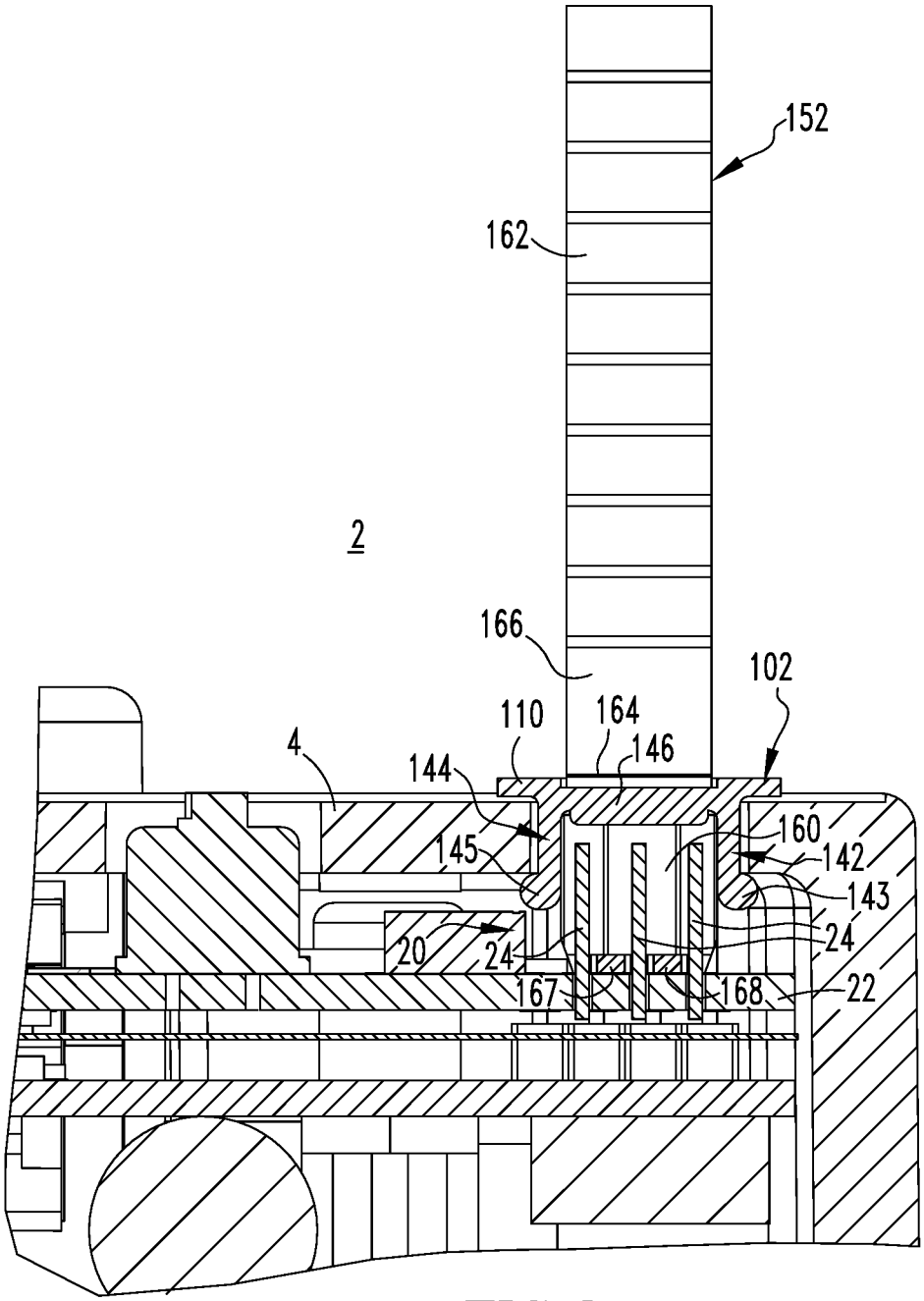
FIG. 8 is a section view of the electrical switching apparatus and maintaining system therefor of FIG. 2, taken along line A-A of FIG. 2.

FIG. 8 shows the circuit breaker 2 with the blocking portion 160 fully inserted through the thru hole in the plate portion 110 and engaging the circuit board 22. It will be appreciated that the insert 102 is structured to engage each of the leg portions 142,144 in order to prevent the leg portions 142,144 from deflecting toward each other, thereby maintaining the test port cover member 102 on the electrical switching apparatus cover 4. More specifically, in the event of a circuit interruption, potential energies that might otherwise tend to eject the test port cover member 102 will be prevented from doing so. For example, the blocking portion 160 of the insert 152 extends from proximate the first leg portion 142 to proximate the second leg portion 144. The blocking portion 160 is also preferably located substantially perpendicular to the leg portions 142,144 and substantially perpendicular to the circuit board 22. As a result, any potential deflection of the leg portions 142,144 inwardly would result in the leg portions 142,144 almost immediately engaging the blocking portion 160, and thus not deflecting inwardly toward each other. Furthermore, the rounded distal end portions 143,145 of the leg portions 142,144 combine to substantially minimize and/or prevent upward (i.e., from the perspective of FIG. 8) movement of the test port cover member 102 with respect to the electrical switching apparatus cover 4. Accordingly, the maintaining system 100 functions as a novel mechanism to maintain the test port cover member 102 on the electrical switching apparatus cover 4, even in the presence of relatively large forces, forces which might cause ejection of existing test port cover members (not shown).

Continuing to refer to FIG. 8, the printed circuit board assembly 20 further includes a first number of circuit pins 24 and a second number of circuit pins (not shown in FIG. 8, but see circuit pin 26 in FIG. 9) each extending from the circuit board 22 toward the plate portion 110 of the test port cover member 102. Additionally, referring to FIG. 9, it will be appreciated that the thru hole in the plate portion 110 through which the insert 152 is inserted is provided between the first guide portion 146 and the second guide portion 148. Accordingly, the insert 152 is located between the first and second guide portions 146,148. As such, when the blocking portion 160 is inserted between the first and second guide portions 146,148, the first and second guide portions 146, 148 advantageously provide a reliable mechanism to guide and direct the blocking portion between the first number of circuit pins 24 and the second number of circuit pins 26, which are relatively closely spaced from each other. That is, the blocking portion 160 extends from proximate the first number of circuit pins 24 to proximate the second number of circuit pins 26. Moreover, the novel geometry of the insert 152 is structured so as to be compatible with the circuit pins 24,26. See, for example, FIG. 8 in which the middle circuit pin 24 of the three circuit pins 24 is located between the protrusions 167,168. It will be appreciated that on the opposing side of the insert, the middle circuit pin 26 of the circuit pins 26 may be located between similar protrusions of the insert 152 on the opposing side.

In addition to the aforementioned advantages of providing significant resistance against potential ejection of the test port cover member 102, the insert is also structured to provide relatively little interference to operators once installed. As stated hereinabove, the gripping portion 162 is structured to pivot about the hinge portion 164. Accordingly, once the blocking portion 160 has been inserted through the plate portion 110 and has reached the position depicted in FIGS. 2, 8, and 9, the gripping portion 162 can relatively easily be pivoted about the hinge portion 164 (i.e., by virtue of the hinge portion 164 being relatively thin) to its position in FIG. 1 (e.g., wherein the gripping portion 162 is disposed substantially perpendicular to the blocking portion 160). In this position, the insert 152 protrudes minimally from the electrical switching apparatus cover 4 of the circuit breaker 2 and it poses relatively little interference to the operation of the circuit breaker 2. Furthermore, as shown in FIG. 3A, the gripping portion 162 has an extension portion 166 extending from the hinge portion 164. The extension portion 166 is thinner than the blocking portion 160 of the insert, whose primary function is to engage the leg portions 142,144 and prevent them from deflecting toward each other. It will be appreciated with reference to FIG. 1 that the extension portion 166 is structured to engage and be located substantially parallel to the shelf portion 114 (FIG. 4). As a result, the recessed shelf portion 114 (FIG. 4) and the relatively thin extension portion 166 function together to traverse the insert 152 over the test port cover member 102 without having the insert 152 protrude a significant distance above the test port cover member 102.

Figure 9:
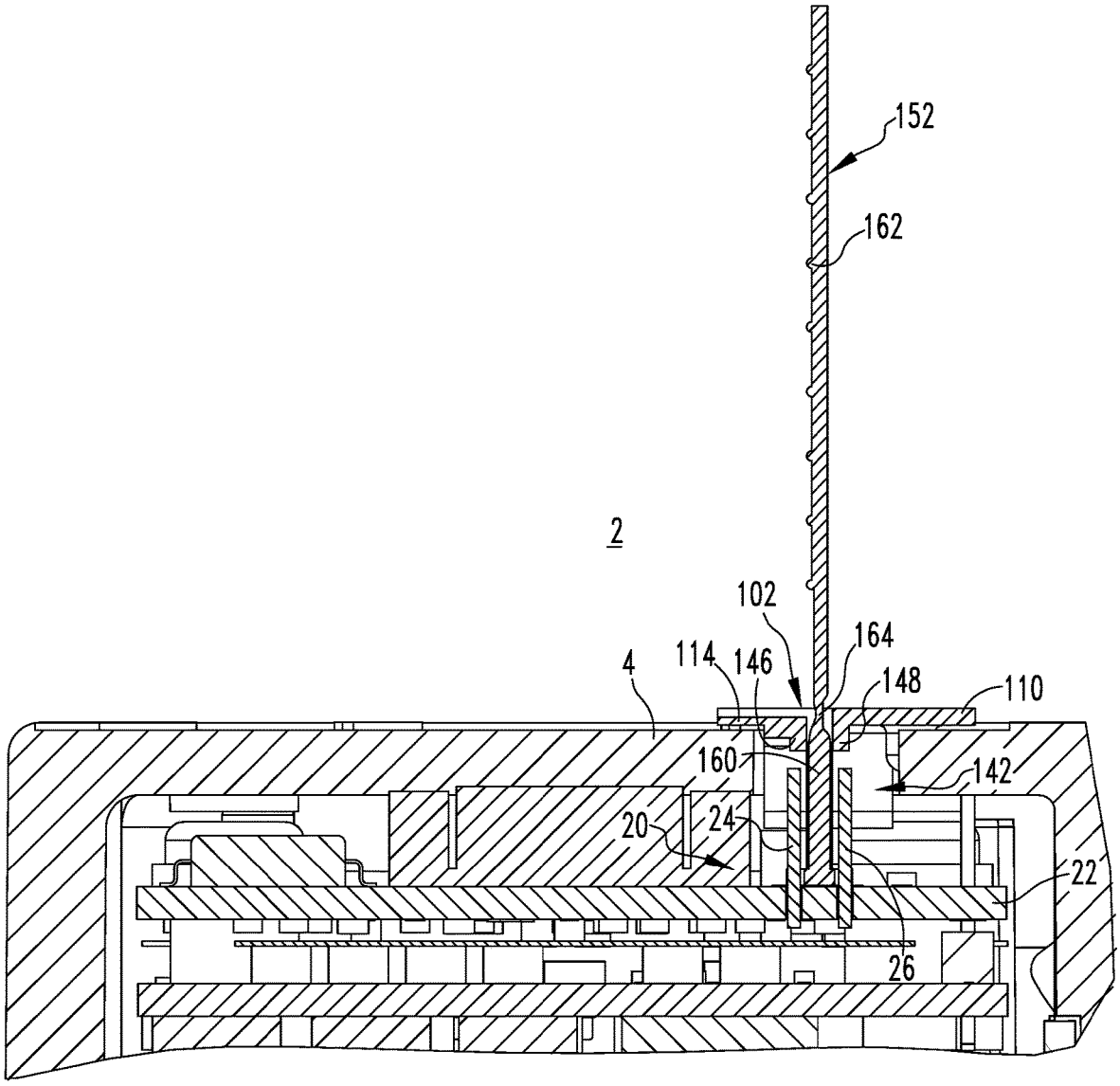
FIG. 9 is another section view of the electrical switching apparatus and maintaining system therefor of FIG. 2, taken along line B-B of FIG. 2.

Finally, if a user desires entry into the circuit breaker 2 via the thru hole defined by the edge portion 6, the user can relatively easily grasp the insert 152 by the gripping portion 162, pivot the gripping portion 162 about the hinge portion 164 so that it reaches its position in FIGS. 2, 8, and 9, and then simply pull the insert 152 upwards so that the blocking portion 160 moves substantially through the test port cover member 102, preferably until the protrusions 167,168 (e.g., and the protrusions of the corresponding opposing side of the insert 152) move into engagement with the guide portions 146,148. With the insert 152 generally no longer functioning as an interfering member for the test port cover member 102, the test port cover member 102 can relatively easily be pulled out of the thru hole (e.g., by causing the leg portions 142,144 to deflect inwardly toward each other). Thus, the user will be able to access the printed circuit board assembly 20 (FIGS. 8 and 9) in the interior of the circuit breaker 2. When the user is complete, the user can cover the thru hole with the test port cover member 102 and press the insert 152 back down until the blocking portion 160 engages the circuit board 22, in the manner described above.

It will be appreciated that a method of maintaining the test port cover member 102 on the electrical switching apparatus cover 4 includes the steps of providing the electrical switching apparatus 2 with the electrical switching apparatus cover 4 having an edge portion 6 defining a thru hole, a printed circuit board assembly 20 comprising a circuit board 22 coupled to the electrical switching apparatus cover 4, and a maintaining system 100 including the test port cover member 102 and an insert 152; providing the test port cover member 102 with a plate portion 110 and a pair of opposing leg portions 142,144 extending from the plate portion 110; providing the insert 152 with a gripping portion 162, a blocking portion 160, and a hinge portion 164 extending therebetween; moving the gripping portion 162 through the plate portion 110 in a first direction with respect to the test port cover member 102; coupling the test port cover member 102 to the edge portion 6 by substantially extending the leg portions 142,144 through the thru hole, the leg portions 142,144 engaging the electrical switching apparatus cover 4; and moving the blocking portion 160 in a second direction with respect to the test port cover member 102, the second direction being opposite the first direction, the insert 152 being structured to engage each of the leg portions 142,144 in order to prevent the leg portions 142,144 from deflecting toward each other, thereby maintaining the test port cover member 102 on the electrical switching apparatus cover 4. The coupling step may further include deflecting the leg portions 142,144 toward each other as the leg portions 142,144 are extended through the thru hole; and moving the leg portions 142,144 away from each other once the leg portions are substantially extended through the thru hole. The method may also further include pivoting the gripping portion 162 about the hinge portion 164 after the blocking portion 160 has been extended through the plate portion 110, thereby causing the gripping portion 162 to be located substantially perpendicular to the blocking portion 160. Finally, the moving the blocking portion 160 step may further include guiding the blocking portion 160 into the electrical switching apparatus 2 with the first and second guide portions 146,148 in order that the blocking portion 160 is located substantially perpendicular to the circuit board 22, and located between the first number of circuit pins 24 and the second number of circuit pins 26.

Accordingly, it will be appreciated that the disclosed concept provides for an improved electrical switching apparatus 2, maintaining system 100 therefor, and associated maintaining method in which a test port cover member 102 is advantageously maintained on an electrical switching apparatus cover 4 of the electrical switching apparatus 2 in a manner wherein forces that might otherwise cause the test port cover member 102 to be undesirably ejected from the electrical switching apparatus 2 are substantially less likely to do so.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A maintaining system for an electrical switching apparatus, said electrical switching apparatus comprising an electrical switching apparatus cover having an edge portion defining a thru hole, said maintaining system comprising:

a test port cover member structured to be coupled to said edge portion, said test port cover member comprising a plate portion and a pair of opposing leg portions extending from said plate portion, said leg portions being structured to extend into an interior of said electrical switching apparatus and engage said electrical switching apparatus cover; and an insert extending through said plate portion, wherein said insert is structured to engage each of said leg portions in order to prevent said leg portions from deflecting toward each other, thereby maintaining said test port cover member on said electrical switching apparatus cover, wherein said insert comprises a blocking portion extending between said leg portions, wherein said insert further comprises a gripping portion and a hinge portion; wherein said hinge portion extends between said gripping portion and said blocking portion; and wherein said gripping portion is structured to pivot about said hinge portion, wherein said plate portion comprises a body portion and a shelf portion; wherein said body portion has a top surface and a cut-out region; wherein said shelf portion extends across said cut-out region; and wherein said shelf portion is spaced from and disposed parallel to said top surface, and wherein said gripping portion comprises an extension portion extending from said hinge portion; and wherein said extension portion is structured to engage and be disposed substantially parallel to said shelf portion.

2. The maintaining system of claim 1 wherein said extension portion is thinner than said blocking portion.

3. The maintaining system of claim 1 wherein said test port cover member and said insert are each unitary components made from single pieces of material.

4. The maintaining system of claim 1 wherein said blocking portion is disposed substantially perpendicular to said leg portions.

5. The maintaining system of claim 1 wherein said test port cover member further comprises a first guide portion and a second guide portion each structured to extend from said plate portion toward the interior of said electrical switching apparatus; and wherein said insert is disposed between said first guide portion and said second guide portion.

6. The maintaining system of claim 5 wherein said first guide portion and said second guide portion are each disposed substantially perpendicular to each of said leg portions.

7. An electrical switching apparatus comprising:

an electrical switching apparatus cover having an edge portion defining a thru hole;

a printed circuit board assembly comprising a circuit board coupled to said electrical switching apparatus cover; and a maintaining system comprising:

a test port cover member coupled to said edge portion, said test port cover member comprising a plate portion and a pair of opposing leg portions extending from said plate portion, said leg portions extending into an interior of said electrical switching apparatus and engaging said electrical switching apparatus cover, and an insert extending through said plate portion, wherein said insert is structured to engage each of said leg portions in order to prevent said leg portions from deflecting toward each other, thereby maintaining said test port cover member on said electrical switching apparatus cover, wherein said insert comprises a blocking portion extending between said leg portions and being disposed substantially perpendicular to said circuit board, and wherein said printed circuit board assembly further comprises a first number of circuit pins and a second number of circuit pins each extending from said circuit board toward said plate portion; and wherein said blocking portion is disposed between said first number of circuit pins and said second number of circuit pins.

8. The electrical switching apparatus of claim 7 wherein said blocking portion extends from proximate said first number of circuit pins to proximate said second number of circuit pins.

9. The electrical switching apparatus of claim 7 wherein said blocking portion of said insert engages said circuit board.

10. The electrical switching apparatus of claim 7 wherein said electrical switching apparatus is an electronic circuit breaker.

11. A method of maintaining a test port cover member of an electrical switching apparatus on an electrical switching apparatus cover of said electrical switching apparatus, the method comprising the steps of:

providing said electrical switching apparatus with said electrical switching apparatus cover having an edge portion defining a thru hole, a printed circuit board assembly comprising a circuit board coupled to said electrical switching apparatus cover, and a maintaining system comprising said test port cover member and an insert;

providing said test port cover member with a plate portion and a pair of opposing leg portions extending from said plate portion;

providing said insert with a gripping portion, a blocking portion, and a hinge portion extending therebetween;

moving said gripping portion through said plate portion in a first direction with respect to said test port cover member;

coupling said test port cover member to said edge portion by substantially extending said leg portions through the thru hole, said leg portions engaging said electrical switching apparatus cover; and moving said blocking portion in a second direction with respect to said test port cover member, the second direction being opposite the first direction, said insert being structured to engage each of said leg portions in order to prevent said leg portions from deflecting toward each other, thereby maintaining said test port cover member on said electrical switching apparatus cover.

12. The method of claim 11 wherein the coupling step further comprises the steps of:

deflecting said leg portions toward each other as said leg portions are extended through the thru hole; and moving said leg portions away from each other once said leg portions are substantially extended through the thru hole.

13. The method of claim 11 wherein the method further comprises;

pivoting said gripping portion about said hinge portion after said blocking portion has been extended through said plate portion, thereby causing said gripping portion to be disposed substantially perpendicular to said blocking portion.

14. The method of claim 11 wherein said printed circuit board assembly further comprises a first number of circuit pins and a second number of circuit pins each coupled to said circuit board; wherein said test port cover member further comprises a first guide portion and a second guide portion each structured to extend from said plate portion toward an interior of said electrical switching apparatus; and wherein the moving said blocking portion step comprises:

guiding said blocking portion into said electrical switching apparatus with said first and second guide portions in order that said blocking portion is disposed substantially perpendicular to said circuit board, and disposed between said first number of circuit pins and said second number of circuit pins.

* * * * *